US005419952A

United States Patent [19]

Brown et al.

[11] Patent Number: 5,419,952

[45] Date of Patent: May 30, 1995

[54] MAKING SLUB YARN ON OPEN-END MACHINE, AND COMPOSITE FABRIC

[75] Inventors: Michael W. Brown, Charlotte; Lee K. Powell, China Grove; James C. Slagle, Jr., Mooresville; Ben M. Croker, Greensboro; Max H. Hance, Mooresville, all of N.C.

[73] Assignee: Burlington Industries, Inc., Greensboro, N.C.

[21] Appl. No.: 66,279

[22] Filed: May 26, 1993

Related U.S. Application Data

[63] Continuation-in-part of Ser. No. 881,263, May 11, 1992.

[51] Int. Cl.[6] ..... D01H 1/12; D01H 7/882; D01H 7/892; D01H 7/00; D02J 3/00

[52] U.S. Cl. ..... 428/255; 428/224; 428/225; 428/226; 428/257; 428/258; 19/112; 19/114; 19/115 R; 139/35; 139/55.1; 139/426 R; 57/404; 57/408; 57/409; 57/411; 57/412; 57/413; 57/91; 57/245; 57/351; 26/27; 8/478

[58] Field of Search ..... 57/404, 408, 409, 411, 57/412, 413, 245, 412, 351, 91; 139/35, 55.1, 426 R; 19/115 R, 112, 114; 428/255, 257, 258, 224, 516

[56] References Cited

U.S. PATENT DOCUMENTS

| | | | |
|---|---|---|---|
| 4,361,007 | 11/1982 | Sumner | 57/409 |
| 4,435,955 | 3/1984 | Sumner | 57/409 |
| 4,805,395 | 2/1989 | Stahlhik et al. | 57/408 |

OTHER PUBLICATIONS

"Effects of Combing-Roll Wire Design . . . "by Simpson & Murray, Textile Research Journal, Sep. 1979, pp. 506 to 512.

"Textile Topics,", Jan., 1991, vol. XIX, No. 5.

Technical Bulletin FRP 503 by Cotton Incorporated, 1986.

"Effect of Carding Conditions on Trash Release in Open-End Spinning" by Supanekar and Nerurkar, Jan., 1979, Textile Research Journal, pp. 26–27.

BSS "Basic dimensions of cones and tubes for winding textile yarns", 1969, four pages.

*Primary Examiner*—Patrick J. Ryan
*Assistant Examiner*—Richard C. Weisberger
*Attorney, Agent, or Firm*—Nixon & Vanderhye

[57] ABSTRACT

Denim fabric is made from warp yarn which is at least 30% novelty cotton yarn having irregularly spaced effects (e.g. slubs) about one-half inch to two inches in length. The cotton novelty yarn is made by separating cotton sliver into cotton fibers, and acting on the cotton fibers with a negative wire combing roll, and then twisting the cotton fibers into the cotton novelty yarn. The negative wire combing roll has a tooth angle of about −0.01 to −15° (e.g. about −2°). The novelty cotton yarn is combined with at least 10% conventional novelty yarn or non-slub open end or ring spun yarn and made into a warp of about 54–100 ends per inch, and may be ring dyed (with indigo, vat, sulphur, pigment or reactive dye) so that the core of the yarn remains white. The warp is woven with a filling yarn to produce a denim fabric with a weight of about 5 oz. –17 oz. per sq. yd. having the weave and yarn size selected so that a tight construction is provided which highlights the slubs. The fabric may be subjected to surface abrasion to remove the surface of dye on the slubs to show a lighter slub than body of the fabric. Alternatively, the warp and filling yarns may be natural, and dyeing practiced after the yarns are woven into a fabric and the fabric made into a garment.

29 Claims, 3 Drawing Sheets

29
30
31
S
28
27
26
Y
25
S
24
20
21
14
23
16
15
12
22
17
F
18
19
S'
C 39
38

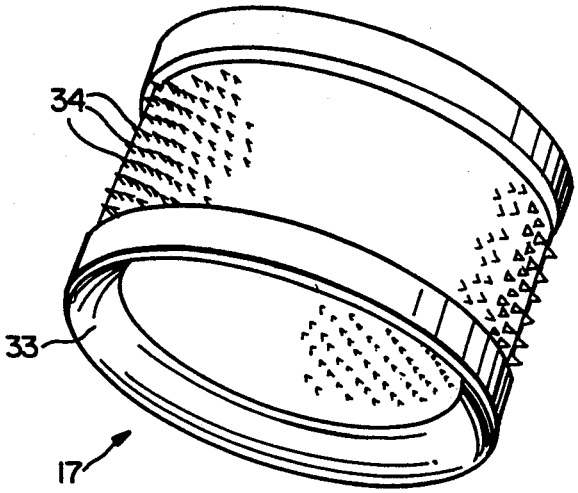
Fig. 2
Fig. 3
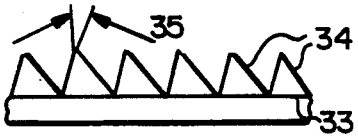
Fig. 5
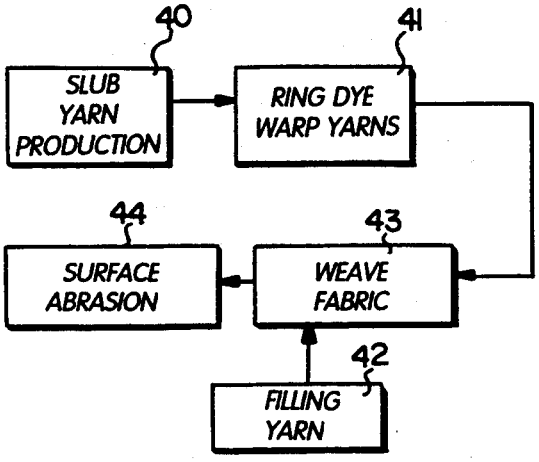

MAKING SLUB YARN ON OPEN-END MACHINE, AND COMPOSITE FABRIC

CROSS REFERENCE TO RELATED APPLICATION

This application is a continuation-in-part of application Ser. No. 07/881,263 filed May 11, 1992.

BACKGROUND AND SUMMARY OF THE INVENTION

A wide variety of novelty yarns have been produced from synthetic fibers, cotton, and other natural fibers. However novelty yarns with short duration irregularities (yarn slubs), of about one inch to four inches in length, have not heretofore been made on open-end spinning equipment because of the very high speed of the spinning rotors (40,000–80,000 rpm), which produce yarn at speeds of 4,000–8,000 inches per minute. This requires making a feed change at 1/66th of second, which has not been physically possible. However, according to the present invention it is now possible to make short duration yarn slubs from cotton fibers on open-end spinning equipment.

According to the present invention, merely by providing a particular configuration of a combing roll, which delivers fibers to the rotors of an open-end spinning machine, it is possible to make random novelty yarn. In fact, it has been found that by using conventional combing rollers which are typically employed for smooth synthetic fibers, such as polyester, the desired yarns according to the invention can be produced. Such combing rolls have negative tooth angles, and according to the invention it has been found that negative angles of about 0.01°–15° (e.g. 2°) are particularly effective. Such rolls have heretofore been considered to be highly undesirable for use with cotton. For example, in an article in the Textile Research Journal by Simpson and Murray, September, 1979, pages 506 to 512, a study was made with open-end combing rolls by varying the combing wire front angle for open-end spinning of cotton between 0° and +30°. The poorest results were obtained at 0° and at 30°, providing a classic indication that negative angle combing rolls have conventionally been considered to be undesirable in the manufacture of cotton yarns.

The cotton yarn produced according to the invention has typical irregularity (e.g. slub) lengths of about one half inch - four inches, normally about one half - two inches. While such yarns have a wide variety of uses, they have been found to be particularly suited for the manufacture of denim fabric. The denim fabric produced from yarns according to the invention has a different look than denim fabrics made by other processes, which is achieved by surface abrading the fabric after construction to remove dye from the surface of the slubs, emphasizing them. The yarns according to the invention may be utilized to make a wide variety of denim fabrics, that are particularly useful when the yarn and weave of the denim are selected to provide a tight construction, which highlights the slubs.

According to a first aspect of the invention in the parent application, a method of open-end spinning cotton novelty yarn utilizing a negative wire combing roll is provided. The method comprises the following steps: (a) Separating cotton sliver into cotton fibers. (b) Acting on the cotton fibers with a negative wire combing roll so that the fibers build up on the teeth of the combing roll and slide away to produce non-uniform bundles of fibers. And, (c) twisting the cotton fibers into cotton novelty yarn, having irregularly spaced (i.e. not in a pattern, but random) irregularities each about one-half inch to four inches in length. Steps (a) through (c) are typically practiced with a twist multiple between about 3.5TM and 9.5%TM, and with a yarn count between about 4.5/1 and 20/1 (e.g. 15/1) Ne, and produce irregularities within the range of one per every thirty inches to one per every one hundred twenty inches of yarn.

When denim fabric is to be made from the yarn according to the invention, it is preferably utilized to construct a warp of about 54–100 ends per inch (e.g. about 54–78 ends per inch), and the warp is usually dyed by ring dyeing or some other method by which the core of the yarn remains white. The random yarn according to the invention may be woven as 100% of the warp or combined with conventional open end spun yarn, ring spun yarn, or other types of conventional novelty yarn, in the warp, and the warp is woven with a filling yarn to produce a denim fabric.

The filling yarn is typically selected from the group consisting essentially of cotton novelty yarn, plain open-end cotton yarn, and plain ring spun cotton yarn, typically having a size of about 4.5/1 to 12/1 Ne, and about 30–70 picks per inch. The weave may be plain (1×1), twill (2×1), warp face sateen, or 3×1 or 4×1 in left hand and right hand twill constructions. The weave is tight so as to highlight the slubs more than a loose weave.

After weaving the fabric, it is subjected to surface abrasion. Typical surface abrading techniques would be stonewashing after the fabric is formed into a garment, or sanding the fabric—prior to garment manufacture—with sandpaper having a grit in the range of about 40–300. These surface abrading techniques remove the surface of the dye on the slub yarn to show a white or lighter slub than the body of the fabric. The fabric weight typically is about 5 oz.–17 oz. per sq. yd., and typically about 50 irregularities (slubs) are provided in a six inch square, providing a unique and desirable affect in the final denim product. Alternatively, the warp and filling yarns may be prepared in the natural state (not dyed), and a final garment produced after the yarns are woven into denim fabric, cut, and sewn, may be dyed (e.g. ring dyed and then abraded). The dye may be indigo, sulphur, vat, pigment, reactive or other dyes known for use in making denim (including sport denim) fabrics.

According to the present invention a method of producing a denim fabric is provided which comprises the following steps: (a) Making a first novelty warp yarn of cotton, having a random configuration of short length effects. (b) Making a second warp yarn at least primarily of cotton. (c) Making a warp comprising at least 30% of the first novelty yarn, and at least 10% of the second warp yarn. (d) Making a primarily cotton filling yarn. (e) Weaving the warp and filling yarn into a tight denim fabric construction which highlights the warp effects. The first novelty yarn is the yarn made utilizing a negative wire combing roll as described above.

Step (b) may be practiced to make a second warp yarn from the group consisting essentially of uniform novelty yarn (made on a conventional novelty yarn machine such as an AUTOCORO® machine with an Amsler-IRO attachment), non-slub open end yarn, and ring spun yarn. Step (c) may be practiced to make a warp comprising about 50–75% yarn from step (a) and about 25–50% yarn from step (b).

Step (c) may be practiced using a warp beam from which a loom removes the yarn for weaving, and there may be the sub-step of placing the warp yarns on the warp beam in a slightly random fashion so that no two warp beams for producing denim fabric will be exactly the same even if they contain exactly the same percentages and types of yarns from steps (a) and (b).

Steps (a) through (e) may be practiced with the yarns in a natural (undyed) state, and then there are the further steps of making the denim fabric into a garment and then dyeing the garment. The dyeing may be practiced utilizing a dye selected from the group consisting essentially of indigo, vat, reactive, pigment and sulphur dyes.

It is the primary object of the present invention to utilize cotton novelty yarn having short duration yarn irregularities (effects), and to produce fabrics with an unusual construction utilizing such yarn. This and other objects of the invention will become clear from an inspection of the detailed description of the invention, and from the appended claims.

BRIEF DESCRIPTION OF THE DRAWINGS

FIG. 2 is a detailed top perspective view of an exemplary combing roller utilizable in the apparatus of FIG. 1 to produce yarn according to the invention;

FIG. 3 is a side schematic illustrating the tooth construction of the roller of FIG. 2;

FIG. 5 is a schematic representation showing the major steps in the manufacture of denim fabric according to the method of the invention.

DETAILED DESCRIPTION OF THE DRAWINGS

Figure 1:
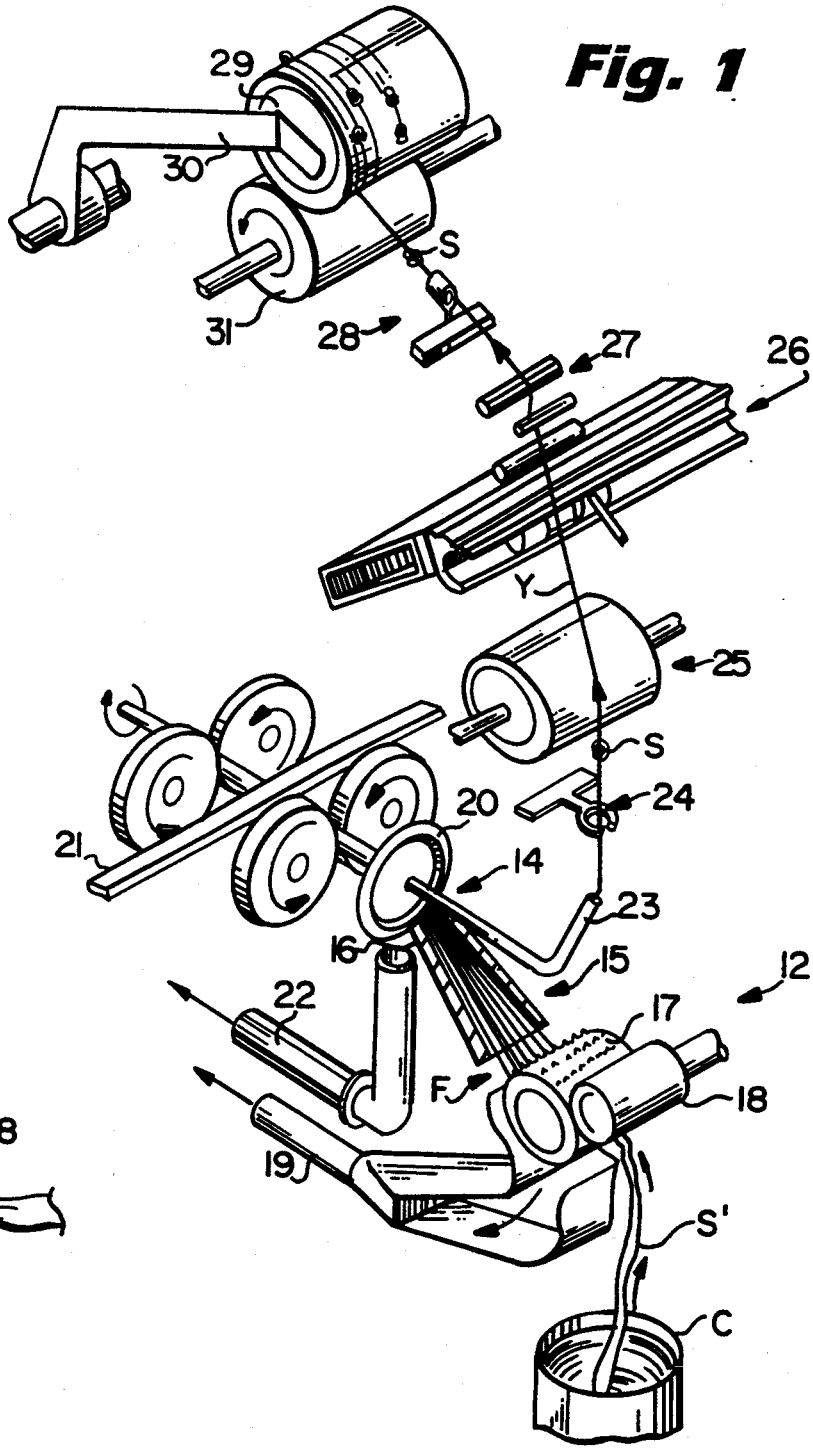
FIG. 1 is a perspective view of exemplary open-end spinning apparatus for making novelty cotton yarn according to the invention.

The apparatus of FIG. 1 is a basically conventional open-end spinning machine, such as an AUTOCORO®, Rieter, or Spin-Flex which includes a fiber separating device 12, a fiber twisting device 14, a fiber transport 15 including a conventional fiber transport tube 16, and an opening (combing) roll 17 cooperating with a feed roll 18, the components 17, 18 feeding cotton sliver S' from a can C. The opening roll 17 separates the sliver S' into the individual fibers F, these cotton fibers being passed to the fiber transport section 15 while suction is provided by suction tube 19 for trash removal. The sliver S' is overfed.

The twisting device 14 illustrated in FIG. 1 comprises a rotor 20 which is powered by a conventional rotor belt 21, with suction for the rotor chamber being provided by the suction tube 22. Yarn Y, with slubs S, produced by rotor 20 passes through yarn outlet tube 23 through a lower traverse 24 to a withdrawal roll 25. The yarn Y so formed then may pass past the "third hand" 26, compensator 27, and upper traverse 28 to the package 29 mounted on package arm 30. Take-up roll 31 cooperates with the package 29 to ensure proper take-up of the yarn Y.

All the components described heretofore in FIG. 1 are conventional for cotton yarn manufacture, except for the particular combing roll 17, which is what allows the production of slubs or irregularities S in the yarn Y. The combing roll 17 includes a body (see FIG. 2) 33, with "negative slope" teeth 34, and is conventional per se, but is conventionally designated for use with synthetic yarns, such as polyester. The teeth 34 - as seen in the schematic illustration in FIG. 3 - have a negative slope, making a negative angle 35. According to the invention, the angle 35 is about −0.01 to −15° (e.g. preferably about −2°). These negative angle teeth 34 cause the fibers to build up on the teeth and on a completely irregular and generally unpredictable basis, to slide away to produce non-uniform bundles of fibers, which are subsequently twisted by fiber twisting device 14 into cotton novelty yarn Y having irregularly spaced irregularities or effects (e.g. slubs) S.

In the utilization of the apparatus of FIG. 1, the method steps for producing the novelty yarn Y are typically practiced with a twist multiple between about 3.5TM and 9.5TM, and so that the irregularities S are produced within the range of about one per every thirty inches to one per every one hundred twenty inches. The yarn count is typically between about 4.5/1 and 20/1 (e.g. 15/1) Ne, for example desirably 5.5/1 to 9.5/1.

The slubs or irregularities S produced according to FIG. 1 vary in length from about one half inch to about four inches (typically about one half inch to two inches). The distance between the slubs can vary from one irregularity per thirty inches to one irregularity per one hundred twenty inches.

Figure 4:
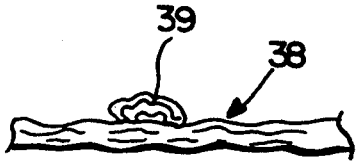
FIG. 4 is a side schematic of the denim fabric produced utilizing the yarn from FIG. 1.

The yarn Y may be used for a warp, and ultimately to produce a fabric, such as the denim fabric 38 schematically illustrated in FIG. 4. As indicated below, the yarn Y can also be used in the filling for producing such a fabric. The warp yarn irregularities 39 (corresponding to irregularities S on the yarn Y of FIG. 1) are irregularly formed along the fabric 38 as schematically illustrated in FIG. 4. For example, there may be about fifty irregularities 39 per six inch square of denim fabric 38.

FIG. 5 schematically illustrates a method of producing denim fabric having an unusual configuration from the novelty yarn Y. Box 40 illustrates the slub yarn production according to FIG. 1 for making 100% novelty warp yarn that is ultimately used in a warp of about 54–100 (e.g. 54–78) ends per inch of about 4.5/1 to 20/1 Ne, that is dyed at block 41. The dyeing step 41 preferably is ring dyeing, or a like dyeing which causes the core of the yarn to remain white.

Filling yarn is produced as illustrated schematically at block 42 in FIG. 5. The filling yarn produced at when denim fabric 38 is to be made, typically is 100% cotton yarn selected from novelty cotton yarn (the same as, or comparable to, that produced according to FIG. 1, or conventional uniform novelty yarn such as made on an AUTOCORO® machine with Amsler-IRO fancy yarn attachment), plain open-end spun yarn, and plain ring spun yarn. Normally the cotton filling yarn has a size of about 4.5/1 to 12/1 Ne, and about 30–70 picks per inch.

As illustrated schematically at 43 in FIG. 5, a woven denim fabric 38 is produced from the warp and filling yarns on a conventional loom. A wide variety of different weaves may be utilized, such as plain weave (1×1), twill weave (2×1), warp face sateen weaves, or 3×1 or 4×1 left hand or right hand twill constructions. It is highly desirable to select a combination of weaves and yarn sizes that result in a tight weave construction, which highlights the slubs 39 more than looser constructions. The fabric 38 typically has a weight of about 5 oz.–17 oz. per sq. yd. One particularly desirable fabric produced according to the invention has about 67 ends per inch of about 6.4/1 warp yarn, and about 45/46 picks per inch of about 6.4/1 filling yarn, and a left hand 3×1 weave construction, with a fabric weight of about 14¾ oz. per square yard.

After construction of the fabric at 43 in FIG. 5, the fabric is subjected to surface abrasion either before or after garment formation. The purpose of the surface abrasion is to remove the surface of dye on the warp yarn to show a white or lighter slub 39 in the body of the fabric 38. This may be constructed by abrading the surface when in fabric form with fine grit sanding paper, e.g. a grit in the range of about 40–300. Alternatively, after the fabric is made into a garment (e.g. jeans, jacket, vest, or the like), the garment may be subjected to stonewashing according to any of several well known procedures. The final fabric produced according to the invention has a different look than heretofore produced denims, one that is aesthetic and desirable.

Figure 6:
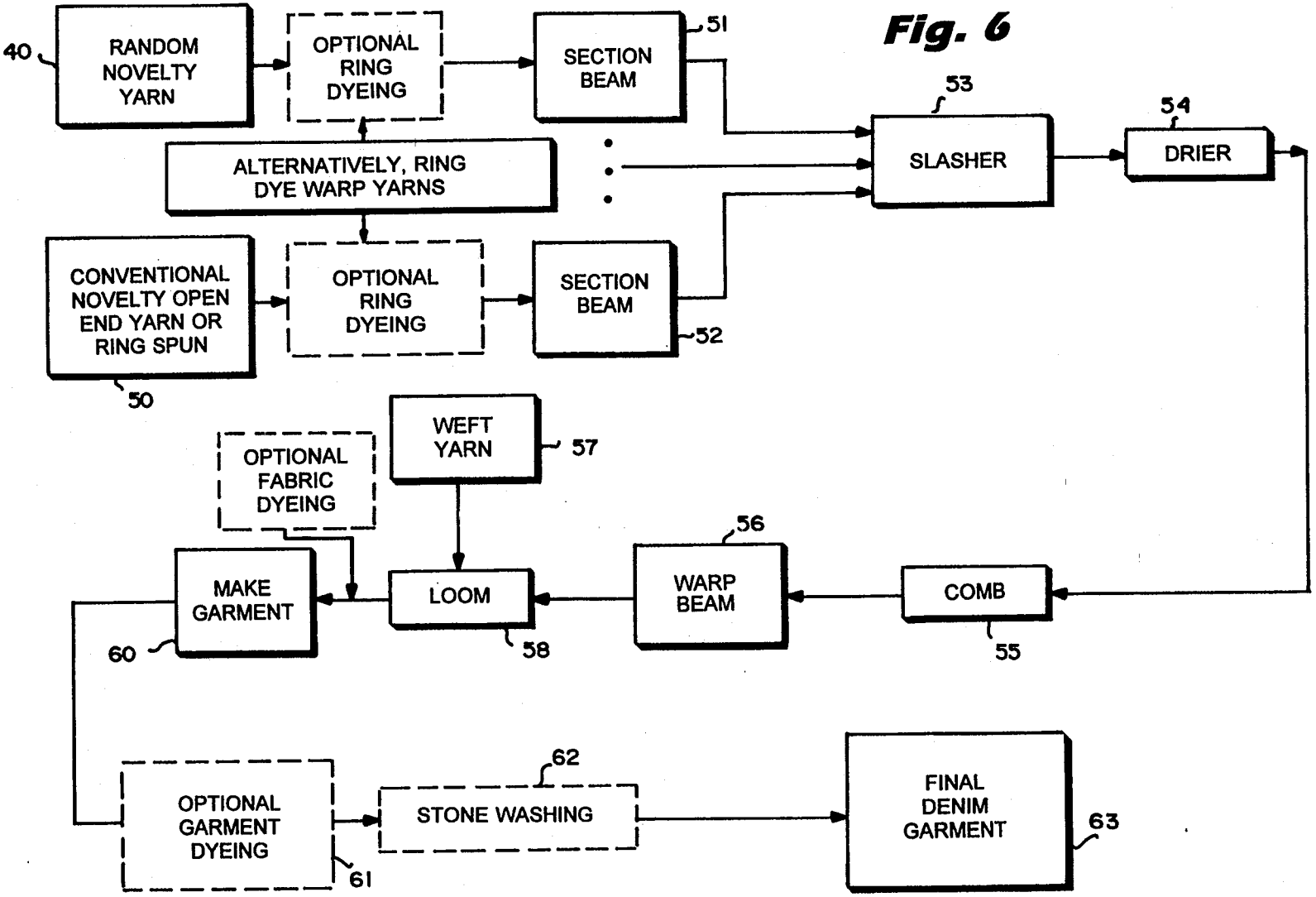
FIG. 6 is a schematic showing exemplary method steps that may be practiced to produce a denim fabric, and garment, according to the present invention.

While denim fabric according to the present invention may be made from 100% random novelty warp yarn according to the present invention, according to the method as schematically illustrated in FIG. 6, the fabric, and subsequent garments, can be made from warp which only comprises a part random novelty yarn according to the invention (e.g. at least about 30%), with the rest being conventional novelty yarn, plain non-slub open end spun yarns or plain ring spun yarns.

Conventional novelty yarn (which is not as irregular as the novelty yarn according to the invention) may be made, for example, on an AUTOCORO® machine with an Amsler-IRO fancy yarn attachment, made by W. Schlafhorst A.G. & Co. of Germany. The uniform novelty yarn has a construction such that even the shortest slubs made thereon are longer than most of the slubs of the random novelty yarn according to the invention, and the slubs of the uniform novelty yarn can be made very long. The length of the slubs, and their spacing, is pre-programmed, variable, and controllable in the uniform novelty yarn, whereas according to the invention the slubs are not only of short length, but are irregularly (randomly) spaced. Also the core of the conventional novelty yarn is always of a substantially uniform thickness, with the slubs being things that are added to the uniform "core" of the yarn; whereas the random novelty yarn of the invention, made pursuant to FIGS. 1 through 4, constantly varies in thickness because the material forming the slub is taken from the material forming the core portion of the yarn.

In the method of FIG. 6, the random novelty yarn according to the present invention is indicated as being produced at box 40 (the same as box 40 in FIG. 5), while a second yarn which is to be added to it in making up the warp is produced at box 50. The yarn produced at 50 is at least primarily of cotton, and is preferably selected from conventional novelty yarn such as made on an Amsler unit as described above, conventional or plain non-slub open end spun yarn, or conventional or plain ring spun yarn. The yarns from both boxes 40 and 50 are made into individual yarn packages which are then placed on creels for winding on section beams 51, 52, etc. For example 300 individual warp yarns or warp ends may be placed on each section beam 51, 52, and for example about twelve section beams may be used to prepare a warp beam or loom beam 56. Some section beams, e.g. section beam 51, will contain the random novelty yarn according to the invention, while other section beams, e.g. 52, will have conventional novelty yarns, plain open end spun yarn; or plain ring spun yarns and both conventional novelty yarn section beams and non-slub yarn section beams may be provided, depending on the fabric style desired.

The yarns from the section beams 51, 52, are taken to a warp slasher 53 to apply textile size (e.g. starch, PVA, or the like) to protect the yarns during subsequent weaving operations. The yarns from each of the section beams 51, 52 are drawn through the slasher 53 size boxes and drying cans in overlapping relationship, thereafter passing over and under conventional lease rods to separate the yarns and keep the yarns from sticking together after completion of the drying process 54 associated with the slasher 53. Ultimately the yarns pass through a conventional comb 55 before passing to the conventional warp beam or loom beam 56.

The section beams 51, 52 may each be as wide as the warp beam 56. While each of the individual warp yarn ends on the warp beam 56 is roughly in the same position as it was on a section beam, because of the length of the slasher 53, permitting slight sideways movement of yarns as they pass through the size boxes and over the drying cans, and because of the comb 55, and because no effort is made to keep the yarns in any precise position, the warp yarns are placed on the warp beam 56 in a slightly random fashion. The individual warp yarns can each move sideways up to about ⅛ inch in either direction during the slashing process in slasher 53, which means that no two warp beams for producing denim fabric will be exactly the same even though they may contain the same percentage of yarn components. For example in a construction utilizing 50% random novelty yarn from box 40, and 50% non-slub open end spun yarn from box 50, it is possible to have two-three slub yarns together and two-three non-slub yarns together because of the sideways movement between the yarns in the slasher 53. Since this positioning is random, each warp beam 56 may differ even though the percentages of the yarns from boxes 40, 50 remain identical.

After the warp beam 56 is formed, the warp yarns are woven with weft yarns from box 57 on a conventional loom 58. The weft yarns are preferably 100% cotton too, although they may be formed from textured polyester filaments to provide a denim fabric having limited stretchability.

The denim fabric produced by the loom 58 may have been made from ring dyed yarns (that is in one or more dyeing steps that would have been carried out between the boxes 40–50 and the boxes 51–52), or dyeing may be accomplished in fabric form after weaving at 58 or after garment formation, at 61. In the exemplary embodiment illustrated in FIG. 6, the denim fabric from loom 58 is made into a garment as indicated at 60, by cutting and sewing, and is then dyed at box 61 after it is made into a garment. While it is preferred that the denim be indigo dyed, to make conventional denim fabric and garments, other dyes may be used to make sports denim fabrics. For example, at any of the above indicated dyeing stages, instead of indigo dyes, vat, reactive, pigment, and sulphur dyes may be utilized instead. For example a black sulphur dye may be utilized to produce what is commonly known as "bull denim".

After dyeing at stage 61, the garment may be stonewashed at stage 62, if desired, and the final denim garment 63 is produced. The dyeing at any of the above indicated dyeing stages (e.g. stage 61) may be ring dyeing so that the cores of the cotton yarns remain undyed and provide a desirable look when the fabric or garment is abraded.

It is preferred, according to the invention as illustrated in FIG. 6, that the random novelty yarn from box 40 comprise at least 30% of the warp, while the conventional novelty or non-slub yarn from box 50 comprise the remainder, preferably at least about 10%. Very desirable results are obtained by using about 50–75% random novelty yarn according to the invention, and about 25–50% conventional novelty and/or non-slub open end spun yarn, and/or ring spun yarn.

It will thus be seen that according to the present invention a method of open-end spinning cotton novelty yarn, a method of producing denim fabric, and an unusual denim fabric having light colored irregularities formed in an unpredictable irregular manner (i.e. not in a pattern) along the surface thereof, are provided. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent fabrics and methods.

What is claimed is:

1. A method of producing a denim fabric, comprising the steps of:

(a) making a first novelty warp yarn of cotton, having a random configuration of effects having a length of about ½ inch to 4 inches;

(b) making a second warp yarn at least primarily of cotton;

(c) making a warp comprising at least 30% of the first novelty yarn, and at least 10% of the second warp yarn;

(e) weaving the warp and filling yarn into a tight denim fabric construction which highllights the warp effects.

2. A method as recited in claim 1 wherein step (a) is practiced utilizing a negative wire combing roll, by the sub-steps of:

(i) separating cotton sliver into cotton fibers;

(ii) acting on the cotton fibers with a negative wire combing roll so that the fibers build up on the teeth of the combing roll and slide away to produce non-uniform bundles of fibers; and (iii) twisting the cotton fibers into cotton novelty yarn, having irregularly spaced effects.

3. A method as recited in claim 2 wherein sub-steps (i)–(iii) are practiced with a twist multiple between about 3.5TM and 9.5TM.

4. A method as recited in claim 3 wherein sub-steps (i)–(iii) are practiced with a yarn count between about 4.5/1 and 15/1 Ne.

5. A method as recited in claim 4 wherein sub-steps (i)–(iii) are practiced to produce the effects within the range of about one per every thirty inches to one per every one hundred twenty inches.

6. A method as recited in claim 2 wherein sub-steps (i)–(iii) are practiced with a yarn count between about 4.5/1 and 20/1 Ne.

7. A method as recited in claim 2 wherein sub-steps (i)–(iii) are practiced to produce the effects within the range of about one per every thirty inches to one per every one hundred twenty inches; and wherein step (a) is further practiced to produce effects having a lenght of about ½ to 2 inches.

8. A method as recited in claim 2 wherein sub-step (ii) is practiced by acting on the fibers with a negative wire combing roll having a tooth angle of about −0.01° to −15°.

9. A method as recited in claim 2 wherein sub-step (ii) is practiced by acting on the fibers with a negative wire combing roll having a tooth angle of about −2°.

10. A method as recited in claim 1 wherein steps (a)–(c) are practiced to make a warp of about 54–100 ends per inch.

11. A method as recited in claim 1 comprising the further step of dyeing the warp prior to the practice of step (e) .

12. A method as recited in claim 11 wherein said dyeing step is practiced by ring dyeing so that the cores of the cotton yarns remain white.

13. A method as recited in claim 1 wherein step (b) is practiced to make a second warp yarn from the group consisting essentially of conventional novelty yarn, non-slub open end yarn, and ring spun yarn.

14. A method as recited in claim 13 wherein step (c) is practiced to make a warp comprising about 50–75% yarn from step (a), and about 25–50% uniform novelty yarn from step (b) .

15. A method as recited in claim 13 wherein step (c) is practiced using a warp beam from which a loom takes the yarn for weaving, and comprising the sub-step of placing the warp yarns on the warp beam in a slightly random fashion so that no two warp beams for producing denim fabric will be exactly the same even if they contain exactly the same percentage and types of yarns from steps (a) and (b).

16. A method as recited in claim 15 wherein step (a) is practicep yarn;

(i) separating cotton sliver into cotton fibers;

(ii) acting on the cotton fibers with a negative wire combing roll so that the fibers build up on the teeth of the combing roll and slide away to produce non-uniform bundles of fibers; and (iii) twisting the cotton fibers into cotton novelty yarn, having irregularly spaced effects each about one-half inch to four inches in length.

17. A method as recited in claim 1 wherein steps (a)–(e) are practiced with yarns in their natural state, and comprising the further steps of (f) making the denim fabric into a garment, and then (g) dyeing the garment.

18. A method as recited in claim 17 wherein step (g) is practiced utilizing a dye selected from the group consisting essentially of indigo, vat, reactive , and sulphur dyes.

19. A method as recited in claim 17 wherein step (g) is practices by ring dyeing.

20. A method as recited in claim 13 wherein step (c) is practiced to make a warp comprising about 50–75% yarn from step (a), and about 25–50% non-slub open end yarn from step (b).

21. A method as recited in claim 10 wherein step (d) is practices to make a filling yarn selected from the group consisting essentially of cottonnovelty yarn, plain open-end cotton yarn, and ring spun cotton yarn, having a size of about 4.5/1 to 12/1 Ne.

22. A method of producing denim fabric, comprising the steps of:

(a) making a cotton warp having about 54–100 ends per inch of about 4.5/1 to 20/1 Ne yarn compriding at least 30% of a first novelty wrap yarn of cotton, having a random configuration of effects havign a length of about ½ inch to 4 inches;

(b) dyeing the warp so that the core of the yarn remains white;

(c) making a cotton filling yarn having a size of about 4.5/1 to 12/1 Ne, and about 30–70 picks;

(d) weaving the warp and filling yarns into a tight denim fabric construction which highlights the warp irregularities; and (e) surface abrading the denim fabric so as to remove the surface of dye on the irregularities to show lighter irregularities than the body of the fabric.

23. A method as recited in claim 22 wherein step (a) is practiced to produce the warp having about 67 ends per inch of about 6.4/1 yarn, and step (c) is practiced to produce about 45/46 picks per inch of about 6.4/1 filling yarn.

24. A method as recited in claim 22 wherein the first novelty yarn is made utilizing a negative wire combing roll, by the sub-steps of:

(i) separating cotton sliver into cotton fibers;

(ii) acting on the cotton fibers with a negative wire combing roll so that the fibers build up on the teeth of the combing roll and slide away to produce non-uniform bundles of fibers; and twisting the cotton fibers into cotton novelty yarn, having irregularly spaced effects each about one-half inch to four inches in length.

25. A method as recited in claim 24 wherein step (a) is practices to make a warp of about 50–75% first novelty yarn, and about 25–50% second yarn, the second yarn selected from the group consisting essentially of uniform novelty yarn and non-slub open end yarn.

26. A method as recited in claim 25 wherein step (d) is practiced using a warp beam from which a loom takes the yarn for weaving, and comprising the sub-step of placing the warp yarns on the warp beam in a slightly random fashion so that no two warp beams for producing denim fabric will be exactly the same even if they contain exactly the same percentage and types of first novelty yarn and second yarn.

27. A denim fabric, having a weight of about 5–17 oz/sq.yd., and light yarn colored effects formed irregularly along the surface thereof, produced by the steps of:

(a) making a cotton warp having about 54–100 ends per inch of about 4.5/1 to 20/1 Ne yarn comprising at least 30% of a first novelty warp yarn of cotton, having a random configuration of effects having a length of about ½ inch to 4 inches;

dyeing the warp so that the core of the yarn remains white;

(c) making a cotton filling yarn having a size of about 4.5/1 to 12/1 Ne, and about 30–70 picks;

(d) weaving the warp and filling yarns into a tight denim fabric construction which highlights the warp irregularities; and (e) surface abrading the denim fabric so as to remove the surface of dye on the irregularities to show lighter irregularities than the body of the fabric.

28. A denim fabric, having a weight of about 5–17 oz./sq.yd., and light colored effects formed irregularly alon the surface thereof, produced by the steps of:

(a) making a first novelty warp yarn of cotton, having a random configuration of effects having a length of about ½ inch to 4 inches;

(b) making a second warp yarn at least primarily of cotton;

(c) making a warp comprising at least 30% of the first novelty yarn, and at least 10% of the second warp yarn;

(d) making a primarily cotton filling yarn; and (e) weaving the warp and filling yarn into a tight denim fabric construction which highlights the warp effects.

29. A method as recited in claim 1 comprising the further step, after step (e), of dyeing the fabric, prior to the fabric being made into a garment.

* * * * *